United States Patent [19]

Holland

[11] 4,132,270

[45] Jan. 2, 1979

[54] METHOD FOR PROTECTION OF WELL EQUIPMENT FROM PARTICLES OF DEBRIS

[75] Inventor: Warren E. Holland, Houston, Tex.

[73] Assignee: Exxon Production Research Company, Houston, Tex.

[21] Appl. No.: 800,832

[22] Filed: May 26, 1977

Related U.S. Application Data

[63] Continuation-in-part of Ser. No. 723,399, Sep. 15, 1976, abandoned.

[51] Int. Cl.[2] ..... E21B 43/08

[52] U.S. Cl. ..... 166/314; 166/315

[58] Field of Search ..... 166/120, 121, 244 R, 166/291, 311, 314, 315; 175/70

[56] References Cited

U.S. PATENT DOCUMENTS

| | | | |
|---|---|---|---|
| 1,585,969 | 5/1926 | Ferguson | 175/70 |
| 2,043,504 | 6/1936 | Blow | 175/70 |
| 2,193,144 | 3/1940 | Rymal | 166/314 X |
| 2,290,431 | 7/1942 | Hoffman | 166/314 X |
| 2,643,094 | 6/1953 | Peter | 175/70 |
| 2,649,915 | 8/1953 | Miller | 166/121 |
| 3,014,528 | 12/1961 | Hurley | 166/244 R |
| 3,126,950 | 3/1964 | Carlberg et al. | 166/244 R |
| 3,246,692 | 4/1966 | Metler et al. | 166/244 R |
| 3,399,723 | 9/1968 | Stuart | 166/315 X |
| 3,878,110 | 4/1975 | Miller et al. | 166/314 X |

*Primary Examiner*—Stephen J. Novosad
*Assistant Examiner*—George A. Suchfield
*Attorney, Agent, or Firm*—Y. S. Finkle; J. S. Schneider

[57] ABSTRACT

Well equipment such as packers, check valves, gas lift valves, sliding sleeves, side pocket mandrels, retrievable plugs and the like located anywhere in a well are protected from particles of solid debris by forming a column of a protective liquid having a density of at least about 3.0 grams per milliliter in contact with and extending above the equipment. The protective liquid serves as a barrier to prevent particles of debris having a density less than that of the liquid from settling on or around the equipment and working their way into small clearances where they may cause operational and other problems.

18 Claims, 2 Drawing Figures

METHOD FOR PROTECTION OF WELL EQUIPMENT FROM PARTICLES OF DEBRIS

CROSS REFERENCE TO RELATED APPLICATIONS

This application is a continuation-in-part of Ser. No. 723,399 filed in the U.S. Pat. and Trademark Office on Sept. 15, 1976 now abandoned.

BACKGROUND OF THE INVENTION

1. Field of the Invention

This invention relates to well equipment that may be located anywhere in a well and is particularly concerned with a method for preventing particles of debris from accumulating around or in the working mechanisms of such equipment.

2. Description of the Prior Art

Well equipment such as packers, check valves, gas lift valves, sliding sleeves, side pocket mandrels, retrievable plugs and the like are frequently used in a variety of different types of wells including producing wells, injection wells, observation wells and service wells. Packers are normally used to seal off the annular space between the tubing string and the casing in a producing well, thereby forcing production fluids upward through the tubing string to the wellhead. Retrievable plugs are normally located in either the casing or the tubing string of a well where they serve to prevent the flow of fluids. Gas lift valves and side pocket mandrels may be used in the tubing string or in the annular space between the tubing string and the casing. No matter where equipment is located in a well, it will normally be covered with some type of fluid. For example, a packer located in the annular space between the tubing string and the casing will normally be surrounded with packer fluid that extends from the top of the packer to the top of the well. This fluid prevents the casing from collapsing inward under the force exerted by pressures in the rock formations surrounding the casing. Similarly, tubing plugs set in the tubing string will normally be covered with production fluids present in the tubing string or with drilling mud that is pumped into the tubing string to kill the well before the plug is inserted and set in place.

Small particles of solid debris in the form of slag, sand, mill scale, corrosion products, metal cuttings, rock cuttings and the like will normally be present in the fluids that cover well equipment whether they be packer fluids, production fluids, drilling muds, brine or similar liquids. Any of these particles that have a density greater than the density of the fluid they reside in may settle downward through the fluid and collect on top of the equipment which the fluid covers. From here they may work their way into small clearances between the equipment and the walls of the tubing string or casing, depending on where the equipment is located, and can cause sticking problems or otherwise interfere with the operation of the equipment. Also, the collection of debris around the top of certain types of equipment may make it difficult to grasp hold of the equipment when it is desired to retrieve it from the well.

SUMMARY OF THE INVENTION

This invention provides a method that alleviates the problems referred to above. In accordance with the invention, it has now been found that well equipment such as packers, check valves, gas lift valves, sliding sleeves, side pocket mandrels, retrievable plugs and the like located anywhere in a well can be protected from fouling with particles of solid debris by forming a column of a protective liquid having a density of at least 3.0 grams per milliliter in contact with and extending above such equipment in the well. The protective liquid forms a barrier around the equipment that prevents the particles of debris having a density less than that of the liquid from settling on or around the equipment and working their way into small clearances where they may cause operational and other problems. The method of the invention may be used in a variety of different types of wells including producing wells such as oil wells, gas wells and water wells; injection wells such as those used for pressure maintenance or water flooding; observation wells that contain equipment in the form of instruments to monitor such variables as bottom hole pressure and temperature; and service wells such as those used to dispose of water by injection into subsurface formations.

In general, it is desired that the density of the protective liquid be higher than the most dense particles of debris present in the well. The substance utilized as the protective liquid may be a solid at atmospheric conditions as long as it is a liquid at the temperatures and pressures existing near the equipment. The protective liquid should normally be chemically stable under the conditions existing near the equipment, should normally have no harmful effects on any metal it may come in contact with and should normally be insoluble or only slightly soluble in any fluid that it comes in contact with in the well. Examples of substances that may be suitable as the protective liquid include iodine, mercury and woods metal.

DESCRIPTION OF THE PREFERRED EMBODIMENTS

Figure 1:
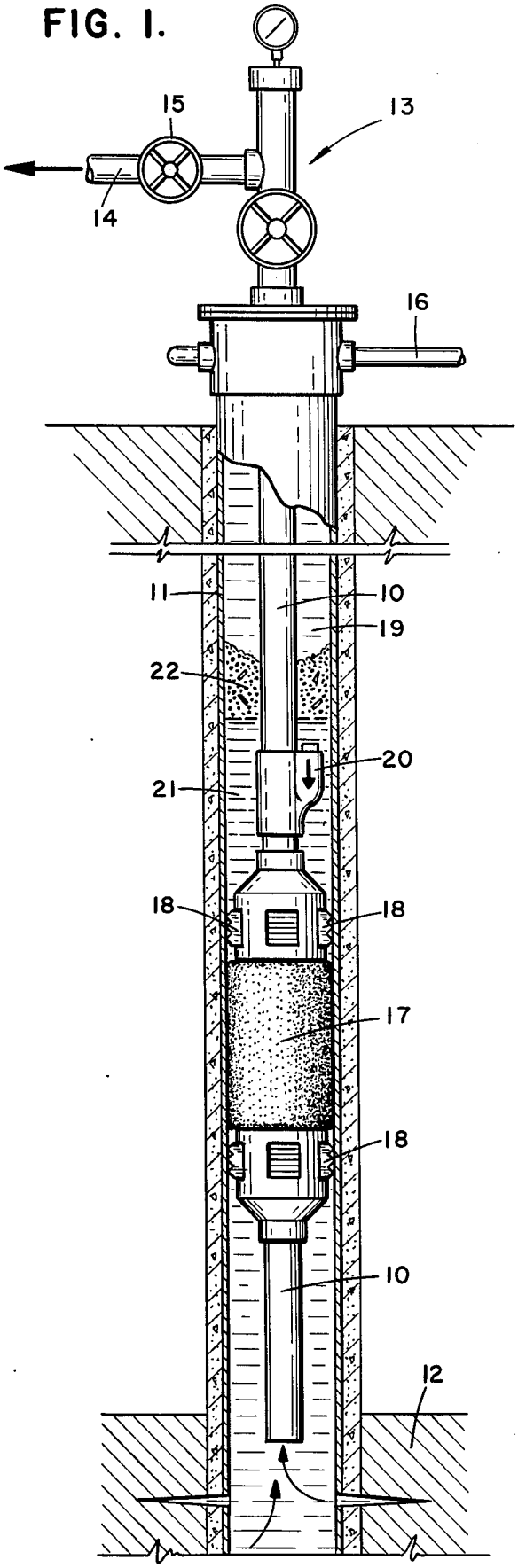
FIG. 1 is a schematic diagram of a producing well that illustrates the use of the invention to protect equipment located in the annular space between the tubing string and the casing of a well.

The producing well shown in FIG. 1 is composed of a tubing string 10 suspended in a well casing 11. Well fluids flow from a subsurface producing formation 12 into the end of the tubing string and through it to the wellhead, generally designated by reference number 13. The wellhead includes a production flowline 14 in which is located a control valve 15. Also located on the wellhead is an injection line 16, which is in fluid communication with the annular space between the tubing string and the well casing. A packer 17 seals the annular space between the tubing string 10 and the well casing 11, thereby forcing the flow of well fluids into and upward through the tubing string. The packer contains several sets of slips 18, which grab the wall of the well casing when the packer is set in place and prevent movement of the packer.

The annular space above the packer between the tubing string and the well casing is filled with packer fluid 19 injected into the annulus through injection line 16. The packer fluid prevents the well casing from collapsing inward by counter balancing the forces exerted by pressure in the rock formations surrounding the casing and may also be formulated to retard corrosion in the annular space. Also, the packer fluid, if heavy enough, may be used to kill the well when production is completed or at any other desired time. If the packer fluid is to be used for such a purpose, check valve or similar injection means 20 is incorporated into the tubing string a short distance above packer 17. When it is desired to kill the well, the pressure exerted by packer fluid 19 is increased to a level that will cause the normally closed check valve to open and force the packer fluid into and upward through the tubing string to the wellhead, thereby producing enough hydrostatic head in the tubing string to counterbalance production pressures.

The packer fluid may be any liquid that is stable under the conditions extant in the annular space between the tubing string and well casing, does not interact with the metal it comes in contact with and is not so dense that it is difficult to pump or exerts too great a pressure on the packer. Examples of a suitable packer fluid include water, an organic liquid, a diesel oil or similar hydrocarbon mixture, and a drilling mud. If it is desirable to use the packer fluid to kill the well, it is normally preferred to utilize a noncorrosive drilling mud as the pcker fluid. Normally, the density of the packer fluid will not exceed about 2.5 grams per milliliter, which is equivalent to about 20.1 pounds per gallon. A density larger than this is not desirable since a fluid of such density may be difficult to pump, may exert too great a pressure on the packer, and may cause damage to the producing formation if injected into the tubing string to kill the well.

The packer fluid in the annular space above the packer will normally contain small particles of solid debris. These particles may be particles of slag, mill scale, metal and other substances that originate during the fabrication of the tubing used to form the tubing string or the fabrication of the pipe used as the well casing. Such particles will be washed off the walls of the casing and the tubing when the packer fluid is injected into the annulus above the packer. In addition, the packer fluid itself may contain particles of debris. This is particularly true if the fluid is a drilling mud, which will normally contain rock cuttings of many different types including, among others, limestone, sand and particles of clay.

Many of the various particles of debris that may be present in the packer fluid in the annulus above the packer will have a density greater than the packer fluid and may settle through the fluid and collect on top of the packer. From here the particles may settle into small clearance areas between the tubing string 10 and the inside of packer 17 and between packer slips 18 and the well casing 11. Once the particles settle into these small clearance areas, they may cause sticking problems that will make it extremely difficult to remove the tubing string from a permanent production packer and to remove a retrievable packer from the well casing. In addition, the small particles may cause operating problems by collecting around other equipment such as check valves, sliding sleeves, side pocket mandrels and the like that may be present in the annulus above the packer. An example of this situation is readily apparent from the drawing. Particles of debris may collect around check valve 20 in such a manner as to block its inlet and thereby make it impossible to inject the packer fluid into the tubing string in an effort to kill the well.

It has been found that the above-described problems that may be caused by the particles of debris that collect on top of a packer and around other equipment may be avoided or at least reduced by forming a column of a protective liquid having a density of at least about 3.0 grams per milliliter above the packer. The protective liquid should normally have a density greater than the density of any particles of debris that are present in the packer fluid being utilized. Because of its relatively high density, the protective liquid forms a barrier around the upper portions of the packer and any other equipment such as check valves, sliding sleeves, side pocket mandrels and the like present in the annulus above the packer. The barrier of protective liquid prevents the particles of debris from settling on and around this equipment and then working their way into small clearances where they may cause operational and other problems.

The substance utilized as the protective fluid may be either a liquid or a solid at atmospheric conditions, but should normally be a liquid at the temperatures and pressures existing near the packer and other equipment in the annular space between the tubing string and the well casing. Also, the protective liquid should normally be chemically stable under conditions near the packer, should normally have no harmful effect on the surrounding metal such as causing those metals to corrode or crack and should normally be insoluble or only slightly soluble in the packer fluid. Examples of substances that may be used as the protective liquid include, among others, woods metal or any similar fusible alloy that is a liquid at the temperatures and pressures existing near the packer and other equipment, mercury, nonmetallic liquids such as methylene iodide and carbon tetrabromide, and nonmetallic solids such as iodine that are liquid at packer temperatures and pressures.

As mentioned previously, the density of the protective liquid will be at least 3.0 grams per milliliter. A density of this magnitude will normally insure that the protective liquid is heavier than any packer fluid that may be used. The actual density of the protective liquid will depend primarily on the various types of debris particles present in the packer fluid. It is preferred that the density of the protective liquid be greater than the most dense particles of debris present in the packer fluid. A density of about 5.20 grams per milliliter or greater will normally insure that the protective liquid is denser that the particles that are most commonly found in the packer fluids including such materials as mill scale (5.18 gm/ml), limestone (2.93 gm/ml), quartz (2.20 gm/ml) and barite (4.50 gm/ml).

Referring again to FIG. 1, the protective liquid is injected through line 16 into the annulus between tubing string 10 and well casing 11 and falls downward through the packer fluid displacing it and forming a column of liquid 21. A sufficient amount of the protective liquid is injected into the annulus to form a column whose height rises above packer 17, check valve 20 and any other equipment that may be present in the annulus above the packer and needs protection. The column of relatively high density liquid serves as a protective barrier by preventing particles of debris from coming in contact with the packer and the check valve. The debris particles, which are lighter than the protective liquid, form a column of debris 22 immediately above the protective liquid 21. It will be understood that the column of protective liquid may be formed from a substance that is a solid at atmospheric conditions but becomes a liquid at the temperatures and pressures existing near the packer. If such is the case, the solids are injected into the annulus and fall downward through the packer fluid. When the solids encounter temperatures above their melting point, they are converted into liquid that collects on top of the packer to form the column or protective barrier 21.

In the above-described embodiment of the invention, a standard production packer is used to seal off the annular space between the tubing string and well casing and to support the column of protective liquid. It will be understood that the process of the invention is not limited to standard production packers but includes within its scope the use of any type of pack-off device that will seal off the annular space and support the column of protective liquid. An example of such an alternative device is a polished bore receptacle.

In the particular embodiment of the invention shown in FIG. 1 and described in detail above, a column of protective liquid having a density of at least about 3.0 grams per milliliter is formed above a packer and other equipment located in the annular space between two concentric pipe strings in a well in order to prevent particles of debris from collecting on or around the packer and other equipment. It will be understood that the method of the invention is not restricted to the embodiment disclosed above but can be utilized to prevent the collection of particles of debris on or around any type of well equipment located anywhere in a well. Thus, a column of such a protective liquid may be formed above equipment such as a gas lift valve, a side pocket mandrel, a retrievable tubing plug or the like located in any pipe string of a well in order to protect such equipment from particles of debris and thereby insure the continued operation and subsequent retrieval of the equipment from the well.

Figure 2:
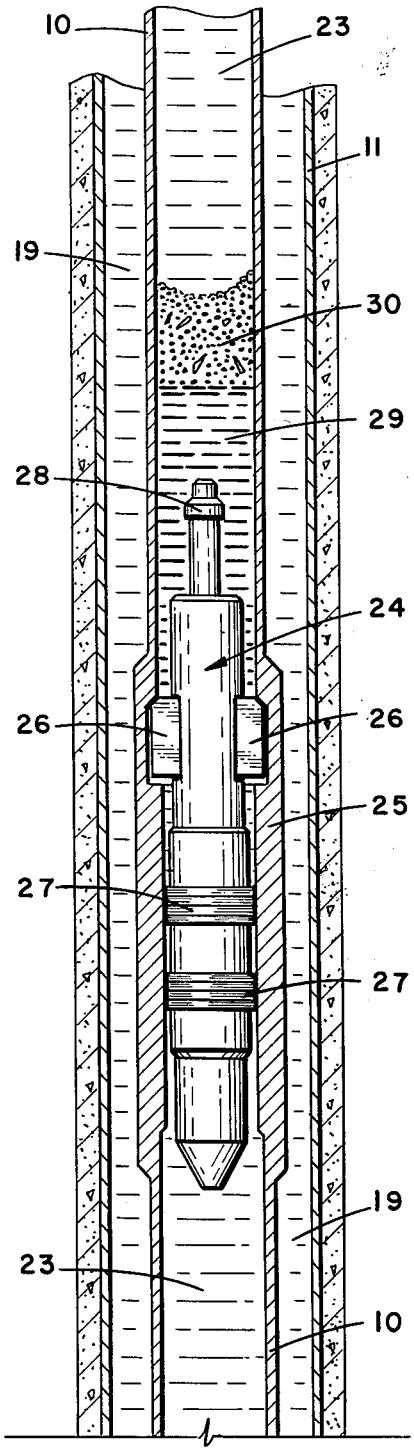
FIG. 2 is an enlarged vertical sectional view of a portion of the tubing string located in the well shown in FIG. 1 that illustrates the use of the invention to protect equipment located inside the tubing string of a well.

FIG. 2 depicts a further embodiment of the invention in which a column of protective liquid is formed above a retrievable tubing plug located in the tubing string of the well shown in FIG. 1. FIG. 2 represents an enlarged sectional view of a portion of the tubing string 10 located above packer 17 and check valve 20 in FIG. 1. The tubing string is filled with well fluids, designated by reference number 23 in FIG. 2, that flow from subsurface producing formation 12 upward through the tubing string 10 to the wellhead 13. At some time during the production of the well fluids, it may be desirable for some reason to discontinue production and temporarily plug the tubing string at a predetermined level with a retrievable tubing plug. Such will normally be the case if some type of workover operation must be performed on the well.

When it becomes desirable to plug the tubing string, the flow of well fluids 23 is terminated by closing control valve 15. A retrievable tubing plug 24, which contains a fishing neck 28, a set of latching dogs 26 and seals 27, is then inserted into the top of the tubing string and allowed to settle through the well fluids to a landing nipple 25, which is incorporated into the tubing string 10. When the retrievable tubing plug reaches the landing nipple, it is forced downward into the nipple until latching dogs 26 lock the tubing plug in place. The seals 27 of the plug 24 insure that no flow of fluids from producing formations located below the level of the tubing plug will occur.

The static well fluids above tubing plug 24 in tubing string 10 will normally contain small particles of solid debris. These particles may be rock fragments such as sand, limestone, shale and clay or other materials that are entrained in the well fluids as they exit the producing formation and rise through the tubing string. In addition the particles of debris may consist of corrosion products or metal cuttings and other particulate matters introduced into the tubing string during workover operations.

Many of the various particles of debris that may be present in the well fluids above the tubing plug will have a density greater than the well fluids, whose density will normally not exceed about 1.2 grams per milliliter, and may settle through the fluids and collect around the fishing neck 28 of the tubing plug 24. If the fishing neck becomes completely covered by debris, it will be extremely difficult to retrieve the plug from the tubing string utilizing conventional tools and procedures when it is again desired to produce the well. Furthermore, particles that collect around the fishing neck may work their way into small clearance areas between the plug and the inside of the tubing string where they may cause sticking problems that may make it even more difficult to retrieve the plug.

The above-mentioned problems that may be caused by the particles of debris may be avoided or at least reduced by forming a column of a protective liquid having a density of at least 3.0 grams per milliliter above the tubing plug and around the fishing neck. The protective liquid, which will have a density greater than the density of the well fluids, forms a barrier around the fishing neck and prevents particles of debris from settling on or around the tubing plug. The actual density of the protective liquid will depend primarily on the various types of debris present in the well fluids. It is preferred that the density of the protective liquid be greater than the most dense particles of debris present in the well fluids.

Referring again to FIG. 2, a column of protective liquid 29 is formed around and above the fishing neck 28 of tubing plug 24. Normally this column is formed by lowering a dump bailer containing the protective liquid through the tubing string to a position directly above the fishing neck and then releasing the protective liquid. A sufficient amount of the protective liquid is released into the tubing string to form a column whose height rises above the fishing neck. The column of relatively high density liquid serves as a protective barrier by preventing the particles of debris from settling around the fishing neck. The debris particles, which are lighter than the protective liquid, form a column of debris 30 immediately above the column of protective liquid 29. As is the case with respect to the embodiment of the invention shown in FIG. 1, the column of protective liquid may be formed from a substance that is a solid at atmospheric conditions but becomes a liquid at the temperatures and pressures existing near the packer. If such is the case, the solids are loaded into a dump bailer, which is lowered through the tubing string to a location near the top of fishing neck 28. The solids are then released from the dump bailer and exposed to temperatures above their melting point. The high temperatures convert the solids into a liquid that collects on top of the tubing plug and around the fishing neck to form the column or protective barrier 29.

In the particular embodiment of the invention shown in FIG. 2 and described in detail above, a column of protective liquid is utilized to prevent particles of debris from collectng on or around equipment located in the tubing string of the same well in which a column of protective liquid is also used to prevent particles of debris from collecting around equipment located in the annular space between two concentric pipe strings. It will be understood that the method of the invention is not restricted to the protection of equipment located in different places in the same well but can be used to protect equipment located in only one place in a particular well. For example, the method of the invention may be used to protect a retrievable tubing plug located in the tubing string of a well even though it is not used to protect equipment in the annular space between the tubing string and the casing of the well.

It will be understood that other changes and modifications may be made in the illustrated embodiments of the invention shown and described above without departing from the scope of the invention as defined in the appended claims.

It should be apparent from the foregoing that the invention provides a method for protecting well equipment such as packers, check valves, sliding sleeves, side pocket mandrels, gas lift valves, retrievable plugs, and the like located anywhere in any type of well from solid debris that might otherwise collect on and around the equipment being protected.

I claim:

1. A method for protecting equipment located in the annular space between two concentric pipe strings in a well from particles of debris which comprises forming a column of a protective liquid in contact with and extending above the said equipment in said annular space, said protective liquid having a density of at least about 3.4 g/ml.

2. A method for protecting equipment located in a pipe string of a well from particles of debris which comprises forming a column of a protective liquid in contact with and extending above said equipment in said pipe string, said protective liquid having a density of at least about 3.0 g/ml.

3. A method as defined by claim 2 wherein said protective liquid comprises mercury.

4. A method as defined by claim 2 wherein said protective liquid comprises woods metal.

5. A method as defined by claim 2 wherein said protective liquid comprises a nonmetallic liquid.

6. A method as defined by claim 2 wherein said protective liquid comprises iodine.

7. A method for protecting equipment located in the tubing string of a well from particles of debris which comprises forming a column of a protective liquid in contact with and extending above said equipment in said tubing string, said protective liquid having a density of at least about 3.0 g/ml.

8. A method as defined by claim 7 wherein said equipment comprises a retrievable tubing plug.

9. A method as defined by claim 7 wherein said equipment comprises a gas lift valve.

10. A method as defined by claim 7 wherein said equipment comprises a side pocket mandrel.

11. A method for protecting stationary equipment located completely within the casing of a well from particles of debris which comprises forming a column of a protective liquid in contact with and extending above said equipment in said casing, said protective liquid having a density of at least about 3.0 g/ml.

12. A method as defined by claim 11 wherein said equipment comprises a retrievable bridging plug.

13. A method for protecting a packer located in the annular space between the tubing string and the casing of a well from particles of debris in the packer fluid contained in said annular space which comprises forming a column of a protective liquid between said packer and said packer fluid, said protective liquid having a density of at least about 3.0 g/ml.

14. A method as defined by claim 13 wherein said protective liquid has a density of at least 5.20 g/ml.

15. A method for protecting a production packer and other equipment located above said packer in the annular space between the tubing string and the casing of a well from particles of debris in the packer fluid contained in said annular space which comprises forming a column of a protective liquid between said packer and said packer fluid, said protective liquid having a density of at least about 3.0 g/ml and extending from said packer to above said other equipment.

16. A method as defined by claim 15 wherein said other equipment comprises a check valve.

17. A method as defined by claim 15 wherein said other equipment comprises a sliding sleeve.

18. In a method for protecting equipment located in the annular space between two concentric pipe strings in a well from particles of debris in which said equipment comprises a pack-off device, the improvement comprising forming a column of a protective liquid in contact with, supported by and extending above said pack-off device in said annular space, said protective liquid having a density of at least about 3.0 g/ml.

* * * * *